US010584905B2

(12) United States Patent
Lee et al.

(10) Patent No.: US 10,584,905 B2
(45) Date of Patent: Mar. 10, 2020

(54) LINEAR COMPRESSOR

(71) Applicant: LG ELECTRONICS INC., Seoul (KR)

(72) Inventors: Kyeongweon Lee, Seoul (KR); Jeehyun Kim, Seoul (KR); Joonsung Park, Seoul (KR); Byunghoon Woo, Seoul (KR); Youngcheol Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 259 days.

(21) Appl. No.: 15/585,368

(22) Filed: May 3, 2017

(65) Prior Publication Data

US 2017/0321937 A1 Nov. 9, 2017

(30) Foreign Application Priority Data

May 3, 2016 (KR) ..... 10-2016-0054911

(51) Int. Cl.

| | |
|---|---|
| ***F25B 43/02*** | (2006.01) |
| ***F04B 39/02*** | (2006.01) |
| ***F04B 35/04*** | (2006.01) |
| ***F04B 39/12*** | (2006.01) |
| ***F04B 39/16*** | (2006.01) |

(52) U.S. Cl.

CPC ..... *F25B 43/02* (2013.01); *F04B 35/045* (2013.01); *F04B 39/0284* (2013.01); *F04B 39/121* (2013.01); *F04B 39/16* (2013.01)

(58) Field of Classification Search

CPC ..... F04B 35/045; F04B 39/0284; F04B 39/0276; F04B 39/023; F04B 39/121; F04B 39/123; F04B 39/16; F25B 43/02

See application file for complete search history.

(56) References Cited

U.S. PATENT DOCUMENTS 4,335,582 A * 6/1982 Shaw ..... F04C 28/06 417/310
4,472,949 A * 9/1984 Fujisawa ..... F25B 43/02 62/468

(Continued)

FOREIGN PATENT DOCUMENTS

CN 1446303 10/2003
CN 1667272 9/2005

(Continued)

OTHER PUBLICATIONS

European Search Report dated Oct. 11, 2017.
Chinese Office Action dated Jul. 27, 2018 (English Translation).

*Primary Examiner* — Charles G Freay
(74) *Attorney, Agent, or Firm* — KED & Associates, LLP

(57) ABSTRACT

A linear compressor is provided that may include a casing, a compressor body accommodated in the casing and defining a compression space for a refrigerant, a suction pipe coupled to a first side of the casing to supply the refrigerant to the compression space, a discharge pipe coupled to a second side of the casing to discharge the refrigerant compressed in the compression space outside of the casing, a process pipe coupled to the second side of the casing spaced apart from the discharge pipe to inject a refrigerant for supplement into the casing, and a separator that separates a mixed fluid of a refrigerant and oil injected through the process pipe.

14 Claims, 8 Drawing Sheets

(56) References Cited

U.S. PATENT DOCUMENTS

| | | | | |
|---|---|---|---|---|
| 7,585,160 | B2 * | 9/2009 | Hirooka | F04B 15/08 184/6.16 |
| 2015/0377531 | A1 | 12/2015 | Lee et al. | |

FOREIGN PATENT DOCUMENTS

| | | | |
|---|---|---|---|
| CN | 105298794 | | 2/2016 |
| CN | 107304759 | | 10/2017 |
| EP | 2466230 | * | 6/2012 |
| JP | H08-86283 | | 4/1996 |
| JP | 2013-53568 | * | 3/2013 |
| JP | 2013-238190 | | 11/2013 |
| KR | 10-2016-0000300 | | 1/2016 |
| WO | WO 2015/025515 | | 2/2015 |
| WO | WO 2016/063400 | * | 4/2016 |

* cited by examiner

LINEAR COMPRESSOR

CROSS-REFERENCE TO RELATED APPLICATION(S)

The present application claims the benefits of priority to Korean Patent Application No. 10-2016-0054911, filed in Korea on May 3, 2016, which is herein incorporated by reference in its entirety.

BACKGROUND

1. Field

A linear compressor is disclosed herein.

2. Background

Cooling systems are systems in which a refrigerant circulates to generate cool air. In such a cooling system, processes of compressing, condensing, expanding, and evaporating the refrigerant are repeatedly performed. For this, the cooling system includes a compressor, a condenser, an expansion device, and an evaporator. Also, the cooling system may be installed in a refrigerator or air conditioner which is a home appliance.

In general, compressors are machines that receive power from a power generation device, such as an electric motor or a turbine, to compress air, a refrigerant, or various working gases, thereby increasing pressure. Compressors are being widely used in home appliances or industrial fields.

Compressors may be largely classified into reciprocating compressors, in which a compression space into/from which a working gas is suctioned and discharged, is defined between a piston and a cylinder to allow the piston to be linearly reciprocated into the cylinder, thereby compressing a refrigerant, rotary compressors, in which a compression space into/from which a working gas is suctioned or discharged, is defined between a roller that eccentrically rotates and a cylinder to allow the roller to eccentrically rotate along an inner wall of the cylinder, thereby compressing a refrigerant, and scroll compressors, in which a compression space into/from which a refrigerant is suctioned or discharged, is defined between an orbiting scroll and a fixed scroll to compress a refrigerant while the orbiting scroll rotates along the fixed scroll. In recent years, a linear compressor, which is directly connected to a drive motor, in which a piston linearly reciprocates, to improve compression efficiency without mechanical losses due to movement conversion, and having a simple structure, is being widely developed.

In general, the linear compressor may suction and compress a refrigerant in a sealed shell while a piston linearly reciprocates within the cylinder by a linear motor and then discharge the refrigerant.

The linear motor is configured to allow a permanent magnet to be disposed between an inner stator and an outer stator. The permanent magnet may linearly reciprocate by an electromagnetic force between the permanent magnet and the inner (or outer) stator. Also, as the permanent magnet operates in the state in which the permanent magnet is connected to the piston, the permanent magnet may suction and compress the refrigerant while linearly reciprocating within the cylinder and then discharge the refrigerant.

Korean Patent Publication No. 10-2016-0000300 (hereinafter, referred to as "prior art document"), which was published on Jan. 4, 2016 and is hereby incorporated by reference, discloses a linear compressor. In the linear compressor of the prior art document, a gas bearing technology in which a refrigerant gas is supplied into a space between a cylinder and a piston to perform a bearing function is disclosed. The refrigerant gas flows to an outer circumferential surface of the piston through a nozzle of the cylinder to act as a gas bearing for the reciprocating piston.

The cylinder has a gas inflow port through which a gas is introduced and a nozzle part through which a refrigerant is discharged. In order to prevent the nozzle part from being clogged by foreign substances, the refrigerant is filtered by a filter device before the refrigerant flows into the gas inflow port.

When an amount of refrigerant is insufficient in a refrigerant cycle which uses the linear compressor employing the gas bearing technology, such as in the prior art document, it is necessary supplement a refrigerant to the linear compressor. However, in a case where oil is included in the refrigerant to be supplemented to the linear compressor, if the oil is not separated from the refrigerant, the oil is suctioned into the compression space together with the refrigerant and compressed therein and then flows into the nozzle side of the cylinder. In this case, the nozzle is dogged with the oil, and the refrigerant gas is not smoothly supplied to the outer circumferential surface of the piston, thus increasing friction between the cylinder and the piston.

BRIEF DESCRIPTION OF THE DRAWINGS

Embodiments will be described in detail with reference to the following drawings in which like reference numerals refer to like elements, and wherein.

DETAILED DESCRIPTION

Figure 1:
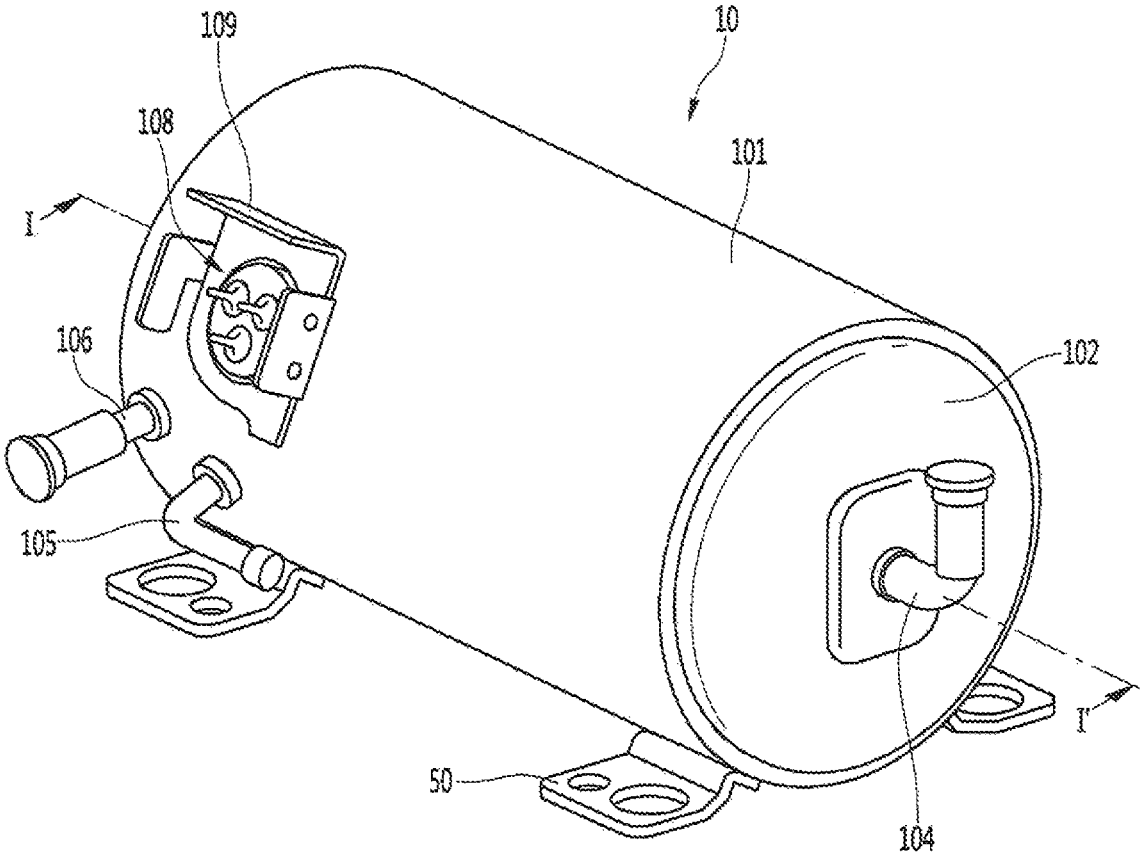
FIG. 1 is a perspective view illustrating an outer appearance of a linear compressor according to an embodiment.

Hereinafter, embodiments will be described in detail with reference to the accompanying drawings. Where possible, like reference numerals have been used to indicate like elements, and repetitive disclosure has been omitted.

Figure 2:
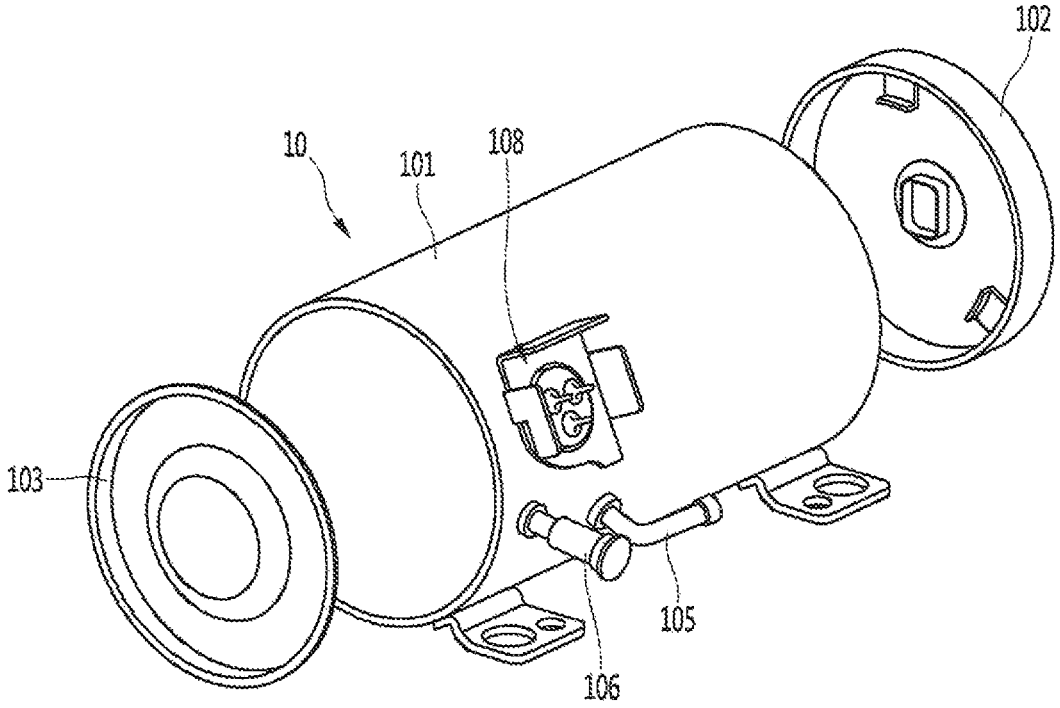
FIG. 2 is an exploded perspective view of a shell and a shell cover of the linear compressor according to an embodiment.

FIG. 1 is a perspective view illustrating an outer appearance of a linear compressor according to an embodiment. FIG. 2 is an exploded perspective view illustrating a shell and a shell cover of the linear compressor according to an embodiment.

Referring to FIGS. 1 and 2, a linear compressor 10 according to an embodiment may include a shell 101 and shell covers 102 and 103 coupled to the shell 101. Each of the first and second shell covers 102 and 103 may be understood as one component of the shell 101. Therefore, the shell 101 and the shell covers 102 and 103 may be collectively referred to as a casing.

A leg 50 may be coupled to a lower portion of the shell 101. The leg 50 may be coupled to a base of a product in which the linear compressor 10 is installed or provided. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, as the linear compressor 10 has a low height, when the linear compressor 10 is installed or provided in the machine room base of the refrigerator, a machine room may be reduced in height.

A terminal 108 may be installed or provided on an outer surface of the shell 101. The terminal 108 may transmit external power to a motor (see reference numeral 140 of FIG. 3) of the linear compressor 10. The terminal 108 may be connected to a lead line of a coil (see reference numeral 141*c* of FIG. 3).

A bracket 109 may be installed or provided outside of the terminal 108. The bracket 109 may include a plurality of brackets that surrounds the terminal 108. The bracket 109 may protect the terminal 108 against an external impact.

Both sides of the shell 101 may be open. The shell covers 102 and 103 may be coupled to both open sides of the shell 101. The shell covers 102 and 103 may include a first shell cover 102 coupled to one open side of the shell 101 and a second shell cover 103 coupled to the other open side of the shell 101. An inner space of the shell 101 may be sealed by the shell covers 102 and 103.

In FIG. 1, the first shell cover 102 may be disposed at a first or right portion of the linear compressor 10, and the second shell cover 103 may be disposed at a second or left portion of the linear compressor 10. That is, the first and second shell covers 102 and 103 may be disposed to face each other.

The linear compressor 10 may further include a plurality of pipes 104, 105, and 106 provided to suction, discharge, or inject the refrigerant. The plurality of pipes 104, 105, and 106 may be provided in the shell 101 or the shell covers 102 and 103.

The plurality of pipes 104, 105, and 106 may include a suction pipe 104 through which the refrigerant may be suctioned into the linear compressor 10, a discharge pipe 105 through which the compressed refrigerant may be discharged from the linear compressor 10, and a process pipe through which the refrigerant may be supplemented to the linear compressor 10.

For example, the suction pipe 104 may be coupled to the first shell cover 102. The refrigerant may be suctioned into the linear compressor 10 through the suction pipe 104 in the axial direction. The suction pipe 104 may be coupled to the shell 101 at a position adjacent to the first shell cover 102.

At least a portion of the suction pipe 104 may be bent upward in a state of being coupled to the first shell cover 102. In this case, when the linear compressor 10 is applied to a refrigerator, a process of coupling pipes is facilitated in a machine room of the refrigerator.

The discharge pipe 105 may be coupled to the shell 101. The refrigerant suctioned through the suction pipe 104 may be compressed while flowing in the axial direction of the shell 101. The compressed refrigerant may be discharged through the discharge pipe 105. The discharge pipe 105 may be disposed or provided at a position which is adjacent to the second shell cover 103 rather than the first shell cover 102. The process pipe 106 will be described hereinafter.

Figure 3:
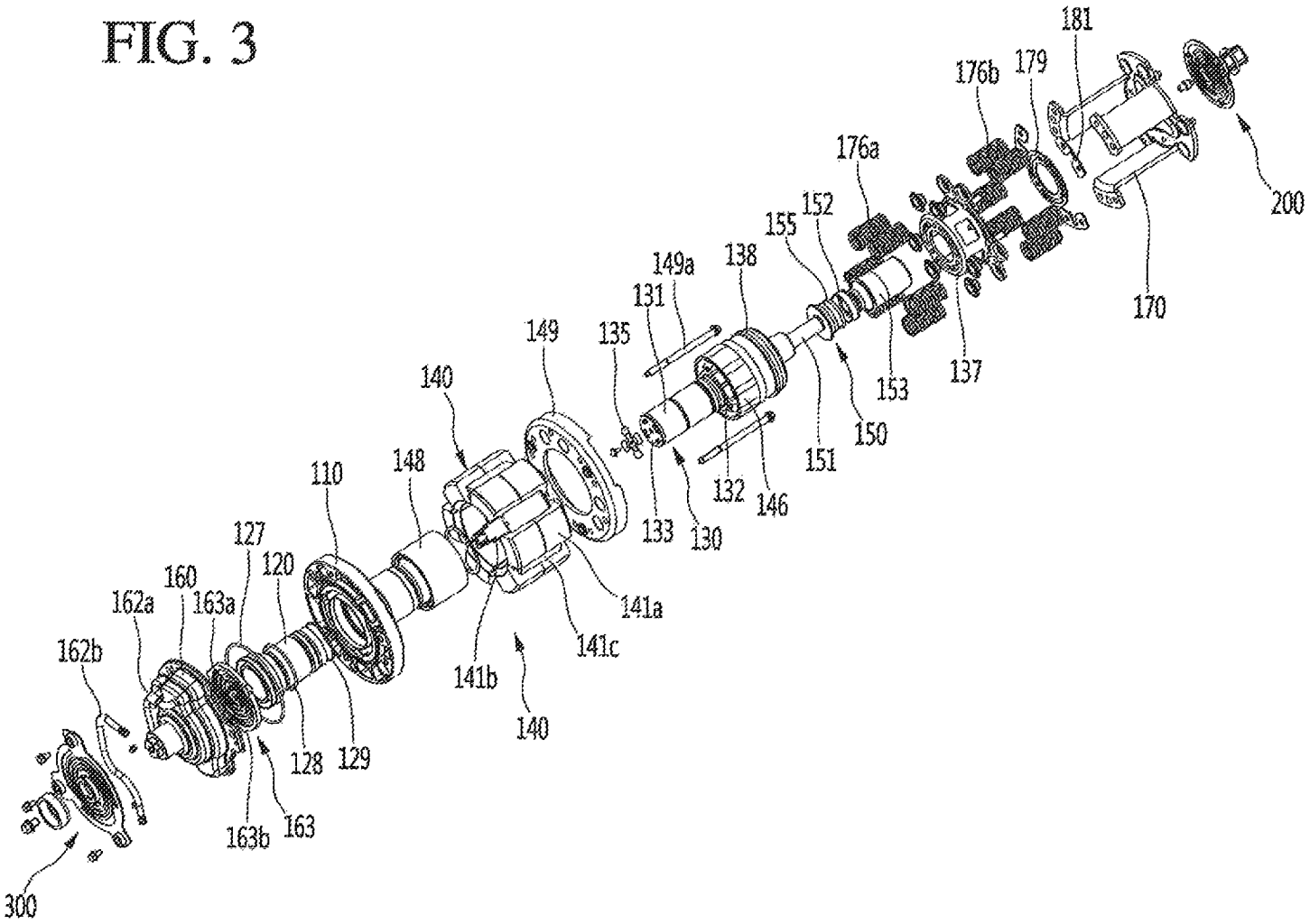
FIG. 3 is an exploded perspective view illustrating internal parts of the linear compressor according to an embodiment.
Figure 4:
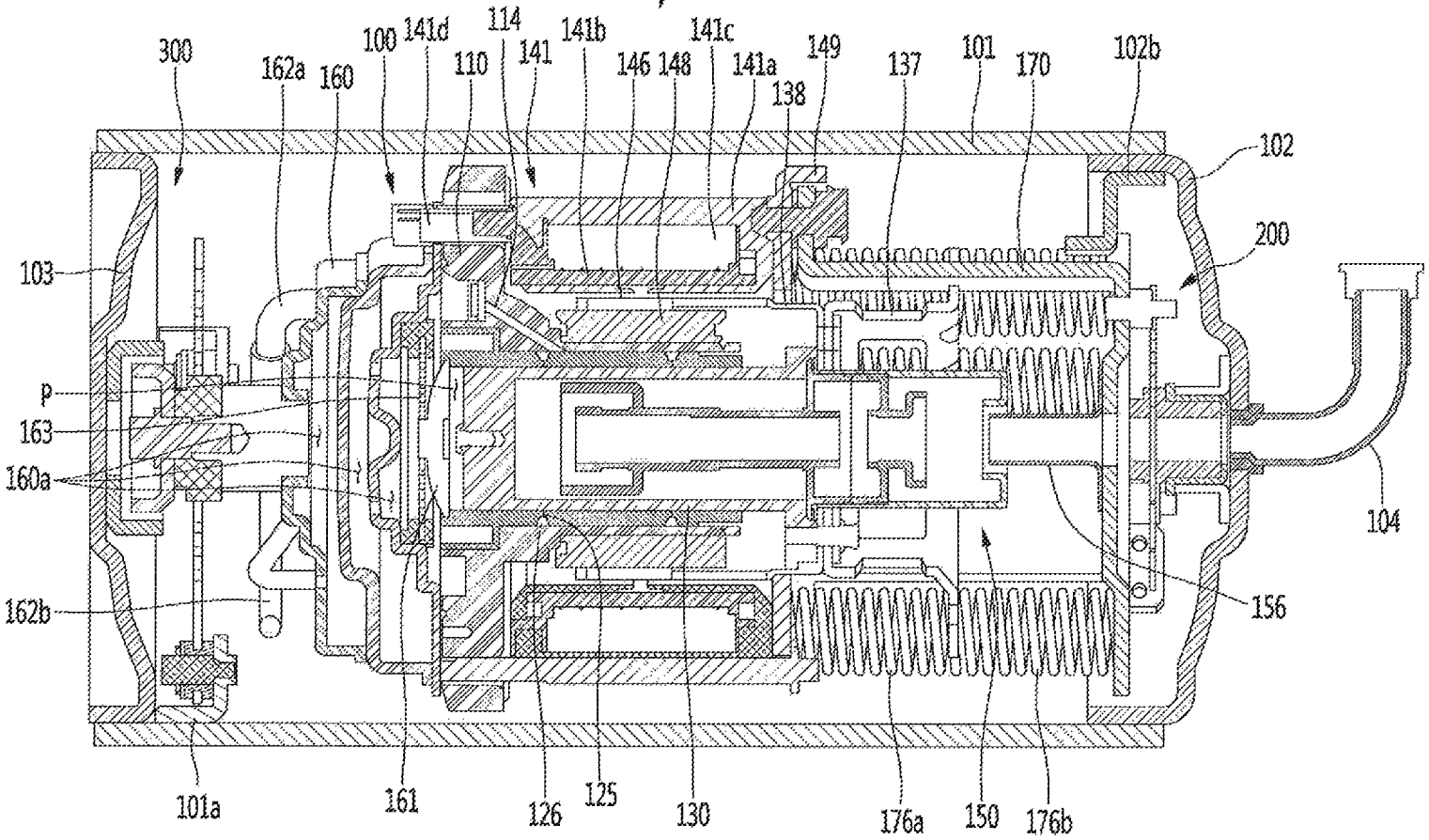
FIG. 4 is a cross-sectional view, taken along line I-I' of FIG. 1.

FIG. 3 is an exploded perspective view illustrating internal parts or components of the linear compressor according to an embodiment. FIG. 4 is a cross-sectional view, taken along line I-I' of FIG. 1.

Referring to FIGS. 3 and 4, the linear compressor 10 according to an embodiment may include a compressor body 100 and a plurality of support devices or supports that the compressor body 100 to one or more of the shell 101 and the shell covers 102 and 103. The compressor body 100 may include a cylinder 120 provided in the shell 101, a piston 130 that linearly reciprocates within the cylinder 120, and a motor 140 that applies a drive force to the piston 130. The motor 140 may include a linear motor. Therefore, when the motor 140 is driven, the piston 130 may reciprocate in the axial direction of the shell 101.

The compressor body 100 may further include a suction muffler 150. The suction muffler 150 may be coupled to the piston 130 to reduce noise generated by the refrigerant suctioned through the suction pipe 104.

The refrigerant suctioned through the suction pipe 104 may flow into the piston 130 via the suction muffler 150. For example, while the refrigerant passes through the suction muffler 150, a flow noise of the refrigerant may be reduced.

The suction muffler 150 may include a plurality of mufflers 151, 152, and 153. The plurality of mufflers 151, 152, and 153 may include a first muffler 151, a second muffler 152, and a third muffler 153, which may be coupled to each other.

The first muffler 151 may be disposed or provided within the piston 130, and the second muffler 152 may be coupled to a rear portion of the first muffler 151. Also, the third muffler 153 may accommodate the second muffler 152 therein and extend to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

The suction muffler 150 may further include a muffler filter 155. The muffler filter 155 may be disposed on or at an interface on or at which the first muffler 151 and the second muffler 152 are coupled to each other. For example, the muffler filter 155 may have a circular shape, and an outer circumferential portion of the muffler filter 155 may be supported between the first and second mufflers 151 and 152.

The "axial direction" defined herein may be a central axis direction of the shell 101 and may be understood as a direction (horizontal direction of FIG. 4) in which the piston 130 reciprocates. Also, in the "axial direction", a direction from the suction pipe 104 toward a compression space P, that is, a direction in which the refrigerant flows may be defined as a "frontward direction", and a direction opposite to the frontward direction may be defined as a "rearward direction". On the other hand, the "radial direction" may be understood as a direction which is perpendicular to the radial direction of the shell 101 or the direction (vertical direction of FIG. 4) in which the piston 130 reciprocates. The "axis of the compressor body" means the central line in the axial direction of the piston 130 or the central axis or central longitudinal axis of the shell 101.

The piston 130 may include a piston body 131 having an approximately cylindrical shape and a piston flange part or flange 132 that extends from the piston body 131 in the radial direction. The piston body 131 may reciprocate inside of the cylinder 120, and the piston flange part 132 may reciprocate outside of the cylinder 120.

The cylinder 120 may be configured to accommodate at least a portion of the first muffler 151 and at least a portion of the piston body 131. The cylinder 120 may have the compression space P in which the refrigerant may be compressed by the piston 130. Also, a suction hole 133, through which the refrigerant may be introduced into the compression space P, may be defined in a front portion of the piston body 131, and a suction valve 135 that selectively opens the suction hole 133 may be disposed or provided on a front side of the suction hole 133. A coupling hole, to which a predetermined coupling member 135*a* may be coupled, may be defined in an approximately central portion of the suction valve 135.

A discharge cover assembly 160 and a discharge valve assembly 161 and 163 may be provided in a front side of the compression space P. The discharge cover assembly 160 may define a discharge space 160*a* for a refrigerant discharged from the compression space P. The discharge valve assembly 161 and 163 may be coupled to the discharge cover assembly 160 to selectively discharge the refrigerant compressed in the compression space P. The discharge space 160*a* may include a plurality of space parts or spaces which may be partitioned by inner walls of the discharge cover assembly 400. The plurality of space parts may be disposed or provided in the frontward and rearward direction to communicate with each other.

The discharge valve assembly 161 and 163 may include a discharge valve 161 and a spring assembly 163. The discharge valve 161 may be opened when a pressure of the compression space P is above a discharge pressure to introduce the refrigerant into the discharge space 401 of the discharge cover assembly 400. The spring assembly 163 may be disposed or provided between the discharge valve 161 and the discharge cover 160 to provide an elastic force in the axial direction.

The spring assembly 163 may include a valve spring 163*a* and a spring support part or support 163*b* that supports the valve spring 163*a* to the discharge cover 160. For example, the valve spring 163*a* may include a plate spring. Also, the spring support part 163*b* may be integrally injection-molded to the valve spring 163*a* through an injection-molding process, for example.

The discharge valve 161 may be coupled to the valve spring 163*a*, and a rear portion or rear surface of the discharge valve 161 may be disposed to be supported on a front surface of the cylinder 120. When the discharge valve 161 is supported on the front surface of the cylinder 120, the compression space P may be maintained in a sealed state. When the discharge valve 161 is spaced apart from the front surface of the cylinder 120, the compression space P may be opened to discharge the refrigerant compressed in the compression space P.

The compression space P may be a space defined between the suction valve 135 and the discharge valve 161. The suction valve 135 may be disposed or provided on or at one or a first side of the compression space P, and the discharge valve 161 may be disposed or provided on or at the other or a second side of the compression space P, that is, an opposite side of the suction valve 135.

While the piston 130 linearly reciprocates within the cylinder 120, when the pressure of the compression space P is below the discharge pressure and a suction pressure, the suction valve 135 may be opened to suction the refrigerant into the compression space P. On the other hand, when the pressure of the compression space P is above the suction pressure, the suction valve 135 may compress the refrigerant of the compression space P in a state in which the suction valve 135 is closed.

When the pressure of the compression space P is above the discharge pressure, the valve spring 163*a* may be deformed forward to open the discharge valve 161. The refrigerant may be discharged from the compression space P into the discharge space of the discharge cover 160. When the discharge of the refrigerant is completed, the discharge valve 161 may be dosed by a restoring force of the valve spring 163*a*.

The compressor body 100 may further include a cover pipe 162*a*. The cover pipe 162*a* may be coupled to the discharge cover assembly 160 to discharge the refrigerant flowing through the discharge space 160*a* of the discharge cover assembly 160. For example, the cover pipe 162*a* may be made of a metal material.

The compressor body 100 may further include a loop pipe 162*b*. The loop pipe 162*b* may be coupled to the cover pipe 162*a* to move the refrigerant flowing through the cover pipe 162*a* to the discharge pipe 105. The loop pipe 162*b* may have one or a first end coupled to the cover pipe 162*a* and the other or a second end coupled to the discharge pipe 105.

The loop pipe 162*b* may include a flexible material. The loop pipe 162*b* may roundly extend from the cover pipe 162*a* along the inner circumferential surface of the shell 101 and be coupled to the discharge pipe 105. For example, the loop pipe 162*b* may have a wound shape.

The compressor body 100 may further include a frame 110. The frame 110 may be configured to fix the cylinder 120. For example, the cylinder 120 may be press-fitted into the frame 110.

The frame 110 may be disposed to surround the cylinder 120. That is, the cylinder 120 may be accommodated in the frame 110. Also, the discharge cover 160 may be coupled to a front surface of the frame 110 using a coupling member.

The frame 110 may define a gas hole 114 for the flow of the refrigerant discharged by the discharge valve 161. The cylinder 120 may define a gas inflow part or inflow 126 through which the gas refrigerant flowing through the gas hole 114 may be introduced.

The gas inflow part 126 may be recessed inward from the outer circumferential surface of the cylinder 121 in the radial direction. Also, the gas inflow part 126 may have a circular shape along the outer circumferential surface of the cylinder 120 with respect to the central axis in the axial direction.

The cylinder 120 may further include a cylinder nozzle 125 that extends inward from the gas inflow part 126 in the radial direction. The cylinder nozzle 125 may extend up to the inner circumferential surface of the cylinder 120.

The refrigerant passing through the cylinder nozzle 125 may be introduced into a space between the inner circumferential surface of the cylinder 120 and the outer circumferential surface of the piston body 131. The gas refrigerant flowing to the outer circumferential surface of the piston body 131 through the cylinder nozzle 125 may provide a lifting force to the piston 130 to perform a function as a gas bearing with respect to the piston 130.

The compressor body 100 may further include a motor 140. The motor 140 may include an outer stator 141 fixed to the frame 110 and disposed to surround the cylinder 120, an inner stator 148 disposed or provided to be spaced inward from the outer stator 141, and a permanent magnet 146 disposed or provided in a space between the outer stator 141 and the inner stator 148.

The permanent magnet 146 may linearly reciprocate by a mutual electromagnetic force between the outer stator 141 and the inner stator 148. The permanent magnet 146 may be provided as a single magnet having one polarity or by coupling a plurality of magnets having three polarities to each other.

The permanent magnet 146 may be installed on a magnet frame 138. The magnet frame 138 may have an approximately cylindrical shape and be inserted into the space between the outer stator 141 and the inner stator 148.

Referring to the cross-sectional view of FIG. 4, the magnet frame 138 may be coupled to the piston flange 132 to extend in an outer radial direction and then be bent forward. The permanent magnet 146 may be installed or provided on or at a front end of the magnet frame 138. When the permanent magnet 146 reciprocates, the piston 130 may reciprocate together with the permanent magnet 146 in the axial direction.

The outer stator 141 may include coil winding bodies 141*b*, 141*c*, and 141*d*, and a stator core 141*a*. The coil winding bodies 141*b*, 141*c*, and 141*d* may include a bobbin 141*b* and a coil 141*c* wound in a circumferential direction of the bobbin 141*b*. The coil winding bodies 141*b*, 141*c*, and 141*d* may further include a terminal part or portion 141*d* that guides a power line connected to the coil 141*c* so that the power line may be led out or exposed to the outside of the outer stator 141.

The stator core 141*a* may include a plurality of core blocks in which a plurality of laminations may be laminated in a circumferential direction. The plurality of core blocks may be disposed to surround at least a portion of the coil winding bodies 141*b* and 141*c*.

A stator cover 149 may be disposed or provided on or at one or a first side of the outer stator 141. That is, the outer stator 141 may have one or a first side supported by the frame 110 and the other or a second side supported by the stator cover 149.

The linear compressor 10 may further include a cover coupling member 149*a* that couples the stator cover 149 to the frame 110. The cover coupling member 149*a* may pass through the stator cover 149 to extend forward to the frame 110 and then be coupled to the frame 110.

The inner stator 148 may be fixed to an outer circumference of the frame 110. Also, in the inner stator 148, the plurality of laminations may be laminated in the circumferential direction outside of the frame 110.

The compressor body 100 may further include a support 137 that supports the piston 130. The support 137 may be coupled to a rear portion of the piston 130, and the muffler 150 may be disposed to pass through an inside of the support 137. The piston flange 132, the magnet frame 138, and the support 137 may be coupled to each other by using a coupling member.

A balance weight 179 may be coupled to the support 137. A weight of the balance weight 179 may be determined based on a drive frequency range of the compressor body 100.

The compressor body 100 may further include a back cover 170 coupled to the stator cover 149 and extending rearward. The back cover 170 may include three support legs; however, embodiments are not limited thereto. The three support legs may be coupled to a rear surface of the stator cover 149. A spacer 181 may be disposed or provided between the three support legs and the rear surface of the stator cover 149. A distance from the stator cover 149 to a rear end of the back cover 170 may be determined by adjusting a thickness of the spacer 181. Also, the back cover 170 may be spring-supported by the support 137.

The compressor body 100 may further include an inflow guide part or guide 156 coupled to the back cover 170 to guide an inflow of the refrigerant into the muffler 150. At least a portion of the inflow guide part 156 may be inserted into the suction muffler 150.

The compressor body 100 may further include a plurality of resonant springs 176*a* and 176*b* which may be adjusted in natural frequency to allow the piston 130 to perform a resonant motion. The plurality of resonant springs 176*a* and 176*b* may include a first resonant spring 176*a* supported between the support 137 and the stator cover 149 and a second resonant spring 176*b* supported between the support 137 and the back cover 170. The piston 130 which reciprocates within the linear compressor 10 may stably move by an action of the plurality of resonant springs 176*a* and 176*b* to reduce vibration or noise due to movement of the piston 130.

The compressor body 100 may further include a plurality of sealing members or seals 127 and 128 that increases a coupling force between the frame 110 and peripheral parts or components around the frame 110. The plurality of sealing members 127 and 128 may include a first sealing member or seal 127 disposed or provided at a portion at which the frame 110 and the discharge cover 160 are coupled to each other. The plurality of sealing members 127 and 128 may further include a second sealing member or seal 128 disposed or provided at a portion at which the frame 110 and the discharge cover 160 are coupled to each other. Each of the first and second sealing members 127 and 128 may have a ring shape.

The plurality of support devices 200 and 300 may include a first support device or support 200 coupled to one or a first side of the compressor body 100, and a second support device or support 300 coupled to the other or a second side of the compressor body 100. As an axial vibration and a radial vibration of the compressor body 100 are absorbed by the plurality of support devices 200 and 300, it is possible to prevent the compressor body 100 from directly colliding with the shell 101 or the shell covers 102 and 103.

Although not limited thereto, the first support device 200 may be fixed to the first shell cover 102, and the second support device 300 may be fixed to the fixing bracket coupled to the inner circumferential surface of the shell 101 at a position adjacent to the second shell cover.

On the other hand, the process pipe 106 may be coupled to an outer circumferential surface of the shell 101. A worker may inject refrigerant into the linear compressor 10 through the process pipe 106. The refrigerant suctioned through the process pipe 106 may be a liquid refrigerant.

When the refrigerant is injected through the process pipe 106, oil existing in a refrigerant injector and/or working oil existing in a cooling system may be injected together with the refrigerant. Even when the oil is injected into the shell 101 together with the refrigerant, the process pipe 106 may be disposed adjacent to the discharge pipe 105 so as to prevent the oil injected into the shell 101 from being introduced into the piston 130.

The process pipe 106 may be disposed or provided at a position which is adjacent to the second shell cover 103 rather than the first shell cover 102. That is, according to embodiments disclosed herein, the suction pipe 104 may be disposed or provided at one or a first side of a reference line halving the shell 101 in the axial direction of the compressor body 100, and the discharge pipe 105 and the process pipe 106 may be disposed at the other or a second side of the reference line. The process pipe 106 may be disposed or provided at a position which is adjacent to the second shell cover 103 rather than the discharge pipe 105.

The discharge cover 160, the frame 110, the motor 140, the stator cover 149, and the back cover 170 may be present or located in a region between the suction pipe 104 and the discharge pipe 105. When the process pipe 106 is adjacent to the discharge pipe 105, the refrigerant injected through the process pipe 105 may flow through a space between the inner circumferential surface of the shell 101 and the compressor body 100 and then be suctioned into the suction muffler 150.

According to embodiments disclosed herein, as the discharge cover 160, the frame 110, the motor 140, the stator cover 149, and the back cover 170 may be present or located on a passage along which the oil injected into the shell 101 flows into the suction muffler 150, the injected oil may adhere to one or more of the discharge cover 160, the frame 110, the motor 140, the stator cover 149, and the back cover 170, thus preventing the oil from being suctioned into the suction muffler 150. Even though the oil adheres to the outer surfaces of various parts or components forming the compressor body 100 in the shell 101, there is no influence on the gas bearing function.

The process pipe 106 may be coupled to the shell 101 at a height different from a height of the discharge pipe 105 so as to avoid interference with the discharge pipe 105. The height is understood as a distance from the leg 50 in the vertical direction (or the radial direction). As the discharge pipe 105 and the process pipe 106 are coupled to the outer circumferential surface of the shell 101 at the heights different from each other, a work convenience may be improved.

Figure 5:
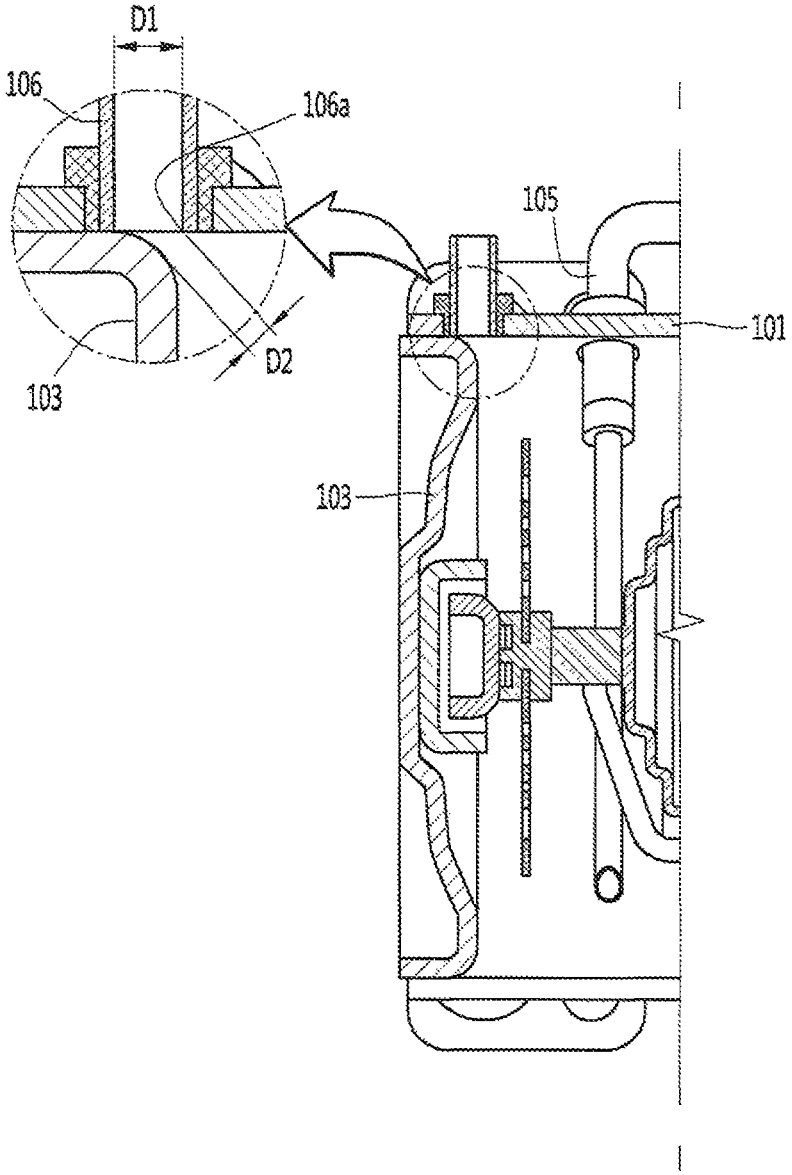
FIGS. 5 and 6 are cross-sectional views illustrating an arrangement relation of a process pipe and a second shell cover according to a first embodiment.
Figure 6:
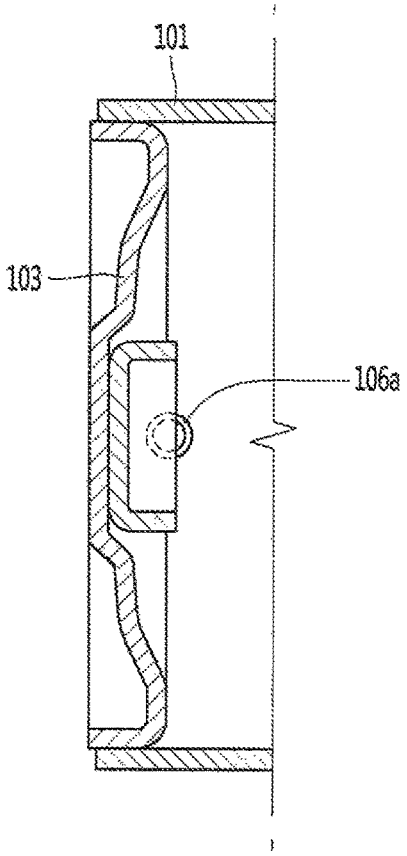

FIGS. 5 and 6 are cross-sectional views illustrating an arrangement relation of the process pipe and the second shell cover according to an embodiment. Referring to FIGS. 5 and 6, in a case in which oil is included in a refrigerant when the refrigerant is injected into the shell 101 through a supply opening 106*a* of the process pipe 106 coupled to the shell 101, a resistor for separation of the refrigerant and the oil may be present in the shell 101.

More specifically, at least a portion of the second shell cover 103 may be disposed or provided on the inner circumferential surface of the shell 101, which corresponds to a point to which the process pipe 106 is coupled. In other words, at least a portion of the second shell cover 103 may act as flow resistance for the refrigerant injected through the process pipe 106. That is, at least a portion of the second shell cover 103 may function as a resistor that limits a flow of the refrigerant.

In order for the second shell cover 103 to act as the flow resistance for the refrigerant, at least a portion of the second shell cover 103 may be disposed to overlap a portion of the supply opening 106*a* in a direction in which the refrigerant is supplied from the process pipe 106. That is, the second shell cover 103 may cover a portion of the supply opening 106*a*.

A diameter D2 of a supply passage defined by the supply opening 106*a* and the second shell cover 103 may be smaller than an internal diameter D1 of the process pipe 106. Therefore, in terms of the passage of the refrigerant, a passage cross-sectional area of the refrigerant introduced through the process pipe 106 may be gradually reduced while entering the inner space of the shell 101.

The inside of the shell 101 may be in a state similar to vacuum. In order to reduce a refrigerant injection time, the refrigerant may be injected into the shell 101 when the linear compressor 10 is driven. As the pressure inside of the shell 101 is in a state similar to vacuum, the liquid refrigerant may be naturally evaporated in the process of injecting the liquid refrigerant through the process pipe 106.

When the linear compressor 10 is in a stopped state, even though a portion of the liquid refrigerant is not evaporated in the process of injecting the liquid refrigerant through the process pipe 106, the liquid refrigerant and the oil may be separated from each other in the shell 101 by a density difference. In a case in which the refrigerant is injected into the shell 101 during the operation of the linear compressor 10, if the liquid refrigerant is not evaporated, the oil may be introduced into the suction muffler 150 without being separated from the liquid refrigerant.

Therefore, when the refrigerant is injected during the operation of the linear compressor 10, the liquid refrigerant needs to be rapidly and completely evaporated and separated from the oil, so as to prevent the oil from being introduced into the suction muffler 150. According to embodiments disclosed herein, when the liquid refrigerant is injected through the process pipe 106, the second shell cover 103 may act as the flow resistance of the refrigerant so that the liquid refrigerant may be rapidly and completely evaporated.

Therefore, according to embodiments disclosed herein, the pressure of the refrigerant may be reduced in the process of injecting the refrigerant, and thus, the liquid refrigerant may be completely evaporated. In this process, the oil included in the refrigerant may be separated from the refrigerant. This is the same principle as the Venturi effect. While passing through a section in which a refrigerant flow area becomes narrow, a pressure of the refrigerant is reduced and a speed of the refrigerant is increased. As a result, the liquid refrigerant is evaporated by the pressure reduction.

When the oil and the refrigerant are separated from each other, only the refrigerant may be suctioned into the piston 130. Thus, it is possible to prevent the cylinder nozzle 125 of the cylinder 120 from being clogged by the oil. The liquid oil separated from the refrigerant may adhere to one or more of the inner circumferential surface of the shell 101, the inner circumferential surface of the second shell cover 103, and the outer circumferential surface of the compressor body 100.

At this time, a diameter D2 of the supply passage may be ½ or less of a diameter D1 of the process pipe 106, so that the pressure of the refrigerant may be sufficiently reduced. Also, a passage cross-sectional area of the supply passage may be 50% or less of a passage cross-sectional area of the process pipe 106. If the passage cross-sectional area of the supply passage exceeds 50% of the passage cross-sectional area of the process pipe 106, the pressure reduction is less, and thus, the liquid refrigerant may not be evaporated.

Also, the passage cross-sectional area of the supply passage may be 30% or more of the passage cross-sectional area of the process pipe 106. If the passage cross-sectional area of the supply passage is less than 30% of the passage cross-sectional area of the process pipe 106, the pressure reduction is great, and thus, the liquid refrigerant may be sufficiently evaporated. However, the refrigerant injection time may be significantly increased, degrading a work efficiency.

In the above embodiment, the second shell cover has been used as the resistor of the refrigerant, but various parts adjacent to the discharge pipe may be used as the resistor. For example, at least a portion of the fixing bracket 101*a* may be used as the resistor.

Figure 7:
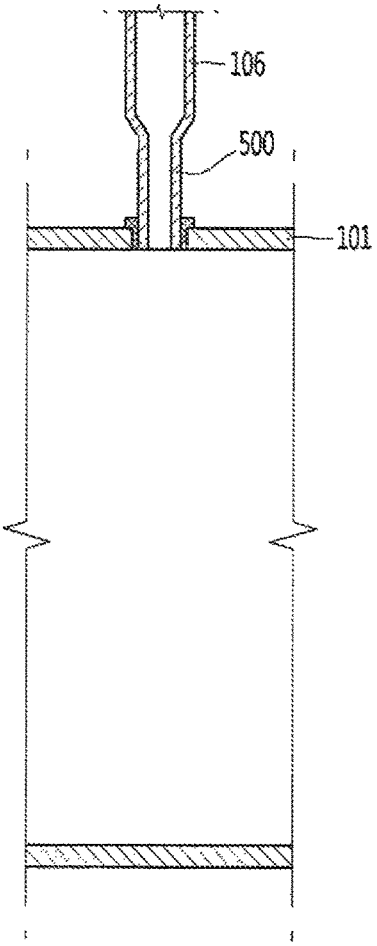
FIG. 7 is a view illustrating a separation pipe for separation of a refrigerant and oil according to a second embodiment.

FIG. 7 is a view illustrating a process pipe according to another embodiment. This embodiment differs from the previous embodiment except for a structure for separation of refrigerant and oil. Therefore, only distinctive or different parts or components of this embodiment will be described hereinafter, and repetitive disclosure has been omitted.

Referring to FIG. 7, the linear compressor according to this embodiment may include a process pipe 106 for refrigerant injection, and a separation pipe 500 that connects the process pipe 106 to the shell 101 or the second shell cover 103 and separates refrigerant and oil from each other. FIG. 7 illustrates an example in which the separation pipe 500 is coupled to the shell 101.

The separation pipe 500 may be molded such that a diameter of a portion of the process pipe 106 is gradually reduced. The process pipe 106 and the separation pipe 500 may be integrally formed as one body, and a separate pipe may be coupled to an end of the process pipe 106. That is, the separation pipe 500 may be a portion that extends from the process pipe 106, or may be an independent pipe member coupled to the process pipe 106.

An internal diameter of the separation pipe 500 may be smaller than an internal diameter of the process pipe 106. Although not limited thereto, the internal diameter of the separation pipe 500 may be ½ or less of the internal diameter of the process pipe 106.

According to this embodiment, liquid refrigerant flowing through the process pipe 106 may be evaporated due to a pressure reduction while flowing through the separation pipe 500, and thus, the liquid refrigerant and the oil may be separated from each other.

According to this embodiment, the refrigerant which is evaporated while flowing through the separation pipe 500 may be injected into the shell 101. The oil separated from the refrigerant may adhere to internal components of the shell 101.

Figure 8:
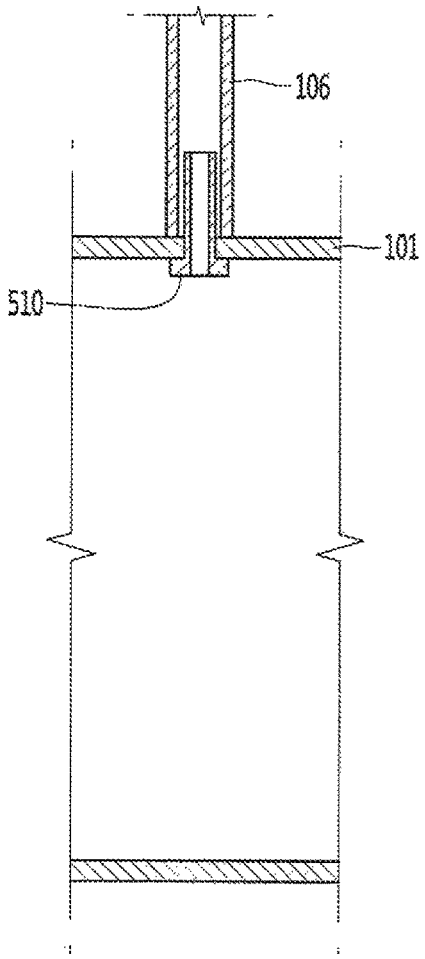
FIG. 8 is a view illustrating a separation pipe for separation of a refrigerant and oil according to a third embodiment.

FIG. 8 is a view illustrating a separation pipe for separation of a refrigerant and oil according to another embodiment. This embodiment differs from the previous embodiments except for a structure for separation of refrigerant and oil. Therefore, only distinctive parts or components of this embodiment will be described hereinafter, and repetitive disclosure has been omitted.

Referring to FIG. 8, the linear compressor according to this embodiment may include a process pipe 106 for refrigerant injection, and a separation pipe 510 inserted into the process pipe 106 so as to separate refrigerant and oil from each other.

The process pipe 106 may be coupled to the shell 101 or the second shell cover 103. The separation pipe 510 may pass through the shell 101 or the second shell cover 103 in the shell 101 and be inserted into the process pipe 106. At this time, an external diameter of the separation pipe 510 may be equal to or smaller than an internal diameter of the process pipe 106. According to this embodiment, the liquid refrigerant flowing through the process pipe 106 may be evaporated due to the pressure reduction while flowing through the separation pipe 500, and thus, the liquid refrigerant and the oil may be separated from each other.

Figure 9:
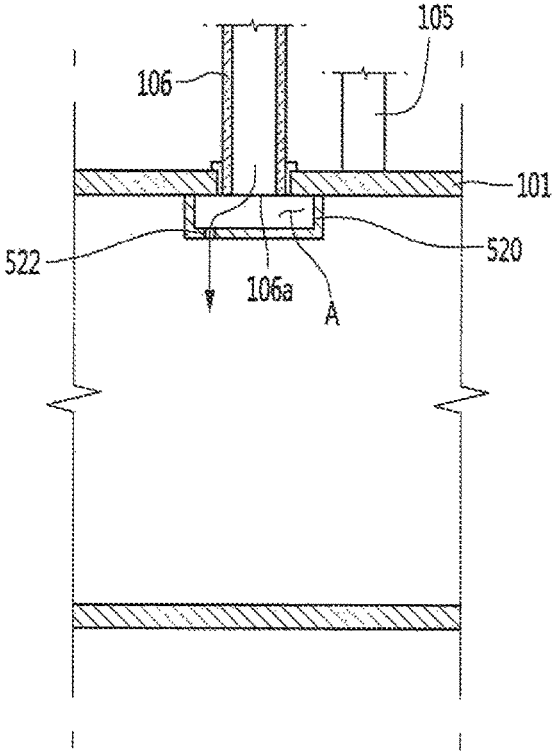
FIG. 9 is a view illustrating a barrier for separation of a refrigerant and oil according to a fourth embodiment.

FIG. 9 is a view illustrating a barrier for separation of refrigerant and oil according to another embodiment. This embodiment differs from the first embodiment except for a method for separating a refrigerant and oil from each other. Therefore, only distinctive parts or components of this embodiment will be described hereinafter, and repetitive disclosure has been omitted.

Referring to FIG. 9, the linear compressor according to this embodiment may include a process pipe 106 for refrigerant injection, and a barrier 520 that increases a flow passage of the refrigerant and the oil injected into the shell 101 through the process pipe 106. The barrier 520 may function as a resistor that resists a flow of the refrigerant flowing into the shell 101. The barrier 520 may define a barrier opening 522 which may be fixed to the inner circumferential surface of the shell 101 or the second shell cover 103 and allow the refrigerant to pass therethrough.

According to this embodiment, while the refrigerant and the oil injected into the shell 101 through the process pipe 106 flow along the barrier 520, the refrigerant and the oil may be separated from each other by a density difference between the refrigerant and the oil, and the oil separated from the refrigerant may adhere to a surface of the barrier 520. That is, as the barrier 520 acts as a flow resistance to the refrigerant, it is possible to sufficiently secure a time for separating the refrigerant and the oil from each other.

The barrier opening 522 may be formed at a point spaced apart from a center toward an edge of the barrier 520. For example, the center of the barrier opening 522 may be formed at a point spaced apart from the center of the supply opening 106*a* in the radial direction of the process pipe 106.

A distance from a line passing through the center of the supply opening 106*a* (or the central axis of the process pipe 106) to a line passing through the center of the barrier opening 522 may be greater than a radius of the supply opening 106*a*. In other words, a distance between the center of the barrier opening 522 to the second shell cover 103 may be shorter than a distance from the center of the supply opening 106*a* to the center of the second shell cover 103.

Due to such a structure, the refrigerant introduced into the shell 101 through the supply opening 106*a* may be introduced into a region A formed by the barrier 520. Among the liquids introduced into the region A formed by the barrier 520, the refrigerant may be discharged into the shell 101 through the barrier opening 522, and the oil may adhere to the surface of the barrier 520.

If the center of the supply opening 106*a* and the center of the barrier opening 522 are on a same line, both the refrigerant and the oil introduced into the region A may be discharged into the shell 101 through the barrier opening 522. Therefore, in order to separate the refrigerant and the oil introduced into the region A formed by the barrier 520, it is suitable that the barrier opening 522 is formed in a region not overlapping the supply opening 106*a*.

According to this embodiment, the oil and the refrigerant may be separated from each other while flowing along the barrier 520, and only the refrigerant may be allowed to flow to the piston, thereby preventing the oil from clogging the cylinder nozzle.

Figure 10:
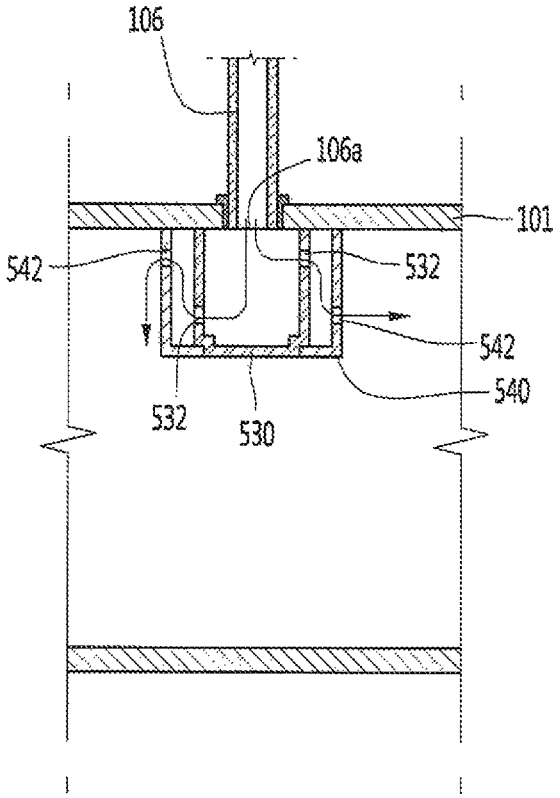
FIG. 10 is a view illustrating a barrier for separation of a refrigerant and oil according to a fifth embodiment.

FIG. 10 is a view illustrating a barrier for separation of refrigerant and oil according to another embodiment. This embodiment differs from the previous embodiments except for a number of barriers for separation of refrigerant and oil. Therefore, only distinctive parts or components of this embodiment will be described hereinafter, and repetitive disclosure has been omitted.

Referring to FIG. 10, the linear compressor according to this embodiment may include a plurality of barriers 530 and 540 that efficiently separates the refrigerant and the oil from each other by increasing an amount of oil adhering to the surface. The plurality of barriers 530 and 540 may include a first barrier 530, and a second barrier 540 that surrounds at least a portion of the first barrier 530. Each of the barriers 530 and 540 may function as a resistor that resists a flow of the refrigerant flowing into the shell 101.

The first barrier 530 may define a first passage for the flow of the refrigerant injected through the process pipe 160. The first barrier 530 may define a first opening 532 through which the refrigerant flowing through the first passage may pass.

The second barrier 540 may include a second passage defined together with the first barrier 530 in order for the flow of the refrigerant passing through the first opening 532 of the first barrier 530 together. The second barrier 540 may define a second opening 542 through which the refrigerant flowing through the second passage may pass.

In order to efficiently separate the refrigerant and the oil from each other during a flow process by increasing a length of the passage through which the refrigerant and the oil flow, the first opening 532 may be defined at a position not overlapping the supply opening 106*a* of the process pipe 106. Also, the second opening 534 may be disposed not to overlap the supply opening 106*a* of the process pipe 106 and the first opening 532 of the first barrier 530 in a direction in which the refrigerant is supplied from the process pipe 106.

Also, at least a portion of the first opening 532 may be disposed to not overlap the second opening 534. In other words, a center of the first opening 532 and a center of the second opening 534 may not be on the same line. It is suitable that the entire first opening 532 does not overlap the second opening 534. Therefore, it is suitable that an edge of the first opening 532 is spaced apart from an edge of the second opening 534.

On the other hand, in this embodiment, the resistor (the second shell cover, the fixing bracket), the separation pipe, and the barrier (including the first barrier and the second barrier) that separates the refrigerant to be injected through the process pipe and the oil included in the refrigerant may be collectively referred to as a "separation mechanism" or "separator".

Embodiments disclosed herein provide a linear compressor in which a refrigerant is separable from oil upon injection of the refrigerant for supplement. Embodiments disclosed herein further provide a linear compressor in which oil injected together with a refrigerant when the refrigerant is injected for supplement is prevented from being introduced into a cylinder.

Embodiments disclosed herein provide a linear compressor that may include a casing; a compressor body accommodated in the casing and defining a compression space for a refrigerant; a suction pipe coupled to one or a first side of the casing to supply the refrigerant to the compression space; a discharge pipe coupled to the other or a second side of the casing to discharge the refrigerant compressed in the compression space to the outside of the casing; a process pipe coupled to the other side of the casing spaced apart from the discharge pipe to inject a refrigerant for supplement into the casing; and a separation mechanism or separator that separates a mixed fluid of a refrigerant and oil injected through the process pipe. The separation mechanism may include a resistor disposed or provided in the casing, and the resistor may be disposed to overlap at least a portion of a supply opening of the process pipe in a direction in which the refrigerant is injected through the process pipe. A diameter of a supply passage defined by the resistor may be smaller than an internal diameter of the process pipe.

The casing may include a shell having a circular shape both ends of which are open; a first shell cover that covers one or a first end of the shell, and a second shell cover that covers the other or a second end of the shell. The resistor may be a portion of the second shell cover. The suction pipe may be coupled to the first shell cover.

The discharge pipe and the process pipe may be installed in the shell. A horizontal plane passing through a center of the discharge pipe and a horizontal plane passing through a center of the process pipe may be different planes. A distance from the process pipe and the second shell cover may be shorter than a distance from the discharge cover to the second shell cover.

The linear compressor may further include a support device or support that supports the compressor body, and a bracket that fixes the support device to an inside of the casing. The resistor may be at least a portion of the fixing bracket.

The separation mechanism may include a barrier that defines a passage of the mixed fluid. The barrier may include a barrier opening through which the refrigerant flowing through the passage may pass, and a center of the barrier opening may be defined at a point spaced apart from a center of the supply opening in a radial direction of the process pipe, such that the barrier opening does not overlap the supply opening of the process pipe.

The separation mechanism may include a first barrier that defines a first passage for the flow of the mixed fluid, and a second barrier that defines a second passage for the flow of the refrigerant passing through the first passage at an outside of the first barrier. The first barrier may include a first opening, and the second barrier may include a second opening. The first opening may be disposed or provided at a position not overlapping the supply opening of the process pipe in a direction in which the refrigerant is injected through the process pipe. The second opening may be disposed or provided at a position not overlapping the supply opening of the process pipe and the first opening of the first barrier in a direction in which the refrigerant is injected through the process pipe.

A center of the first opening and a center of the second opening may be on different lines, such that the first opening does not overlap the second opening, and an edge of the first opening and an edge of the second opening may be spaced apart from each other. The separation mechanism may include a separation pipe that connects the process pipe to the casing and having an internal diameter smaller than an internal diameter of the process pipe.

The separation pipe may be a portion that extends from the process pipe or an independent pipe coupled to the process pipe. The separation mechanism may include a separation pipe that passes through the casing and inserted into the process pipe.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a casing;

a compressor body accommodated in the casing and defining a compression space for a refrigerant;

a suction pipe coupled to a first side of the casing to supply the refrigerant to the compression space;

a discharge pipe coupled to a second side of the casing to discharge the refrigerant compressed in the compression space outside of the casing;

a process pipe coupled to the second side of the casing spaced apart from the discharge pipe to inject a refrigerant for supplement into the casing; and a separator that separates a mixed fluid of a refrigerant and oil injected through the process pipe, wherein the separator includes a resistor provided in the casing, and wherein the resistor overlaps at least a portion of a supply opening of the process pipe in a direction in which the refrigerant is injected through the process pipe.

2. The linear compressor according to claim 1, wherein a diameter of a supply passage defined by the resistor is smaller than an internal diameter of the process pipe.

3. The linear compressor according to claim 1, wherein the casing includes:

a shell having a circular shape both ends of which are open;

a first shell cover that covers a first end of the shell; and a second shell cover that covers a second end of the shell, wherein the resistor is a portion of the second shell cover.

4. The linear compressor according to claim 3, wherein the suction pipe is coupled to the first shell cover.

5. The linear compressor according to claim 4, wherein the discharge pipe and the process pipe are provided in the shell, and a horizontal plane that passes through a center of the discharge pipe and a horizontal plane that passes through a center of the process pipe are different planes.

6. The linear compressor according to claim 5, wherein a distance from the process pipe to the second shell cover is shorter than a distance from the discharge pipe to the second shell cover.

7. The linear compressor according to claim 1, further including:

a support that supports the compressor body; and a bracket that fixes the support to an inside of the casing, wherein the resistor is at least a portion of the fixing bracket.

8. The linear compressor according to claim 1, wherein the separator includes a barrier that defines a passage for the mixed fluid.

9. The linear compressor according to claim 8, wherein the barrier includes a barrier opening through which the refrigerant flowing through the passage passes, and wherein a center of the barrier opening is defined at a point spaced apart from a center of the supply opening in a radial direction of the process pipe, such that the barrier opening does not overlap the supply opening of the process pipe.

10. The linear compressor according to claim 1, wherein the separator includes:

a first barrier that defines a first passage for the flow of the mixed fluid; and a second barrier that defines a second passage for the flow of the refrigerant passing through the first passage at an outside of the first barrier.

11. The linear compressor according to claim 10, wherein the first barrier includes a first opening, wherein the second barrier includes a second opening, wherein the first opening is provided at a position not overlapping the supply opening of the process pipe in a direction in which the refrigerant is injected through the process pipe.

12. The linear compressor according to claim 11, wherein the second opening is provided at a position not overlapping the supply opening of the process pipe and the first opening of the first barrier in a direction in which the refrigerant is injected through the process pipe.

13. The linear compressor according to claim 11, wherein a center of the first opening and a center of the second opening are on different lines, such that the first opening does not overlap the second opening, and an edge of the first opening and an edge of the second opening are spaced apart from each other.

14. The linear compressor according to claim 1, wherein the separator includes a separation pipe that passes through the casing and is inserted into the process pipe.

* * * * *